US006457838B1

(12) United States Patent
Dugmore et al.

(10) Patent No.: US 6,457,838 B1
(45) Date of Patent: Oct. 1, 2002

(54) FLASHLIGHT ADAPTOR

(75) Inventors: Peter Balfour Dugmore; Gwendy Helen Hayward, both of Cape Town; Paul Bunn, Western Cape, all of (ZA)

(73) Assignee: Designodev Limited, St. Helier, NJ (US)

( * ) Notice: Subject to any disclaimer, the term of this patent is extended or adjusted under 35 U.S.C. 154(b) by 0 days.

(21) Appl. No.: 08/798,901

(22) Filed: Feb. 11, 1997

Related U.S. Application Data

(63) Continuation of application No. PCT/GB94/01761, filed on Aug. 11, 1994.

(51) Int. Cl.[7] ..... F21L 15/14

(52) U.S. Cl. ..... 362/106; 362/105; 362/108

(58) Field of Search ..... 362/106, 105, 362/108, 120, 190, 396, 397, 398, 421, 427, 430; 248/220.21, 220.22, 221.11, 222.13, 223.41, 223.21, 206.5, 291.1

(56) References Cited

U.S. PATENT DOCUMENTS

| | | | | | |
|---|---|---|---|---|---|
| 1,318,850 | A | * | 10/1919 | De Yong | 362/396 |
| 1,530,402 | A | * | 3/1925 | Parker | 362/105 |
| 1,540,372 | A | * | 6/1925 | Sears | 362/105 |
| 1,684,347 | A | * | 9/1928 | Dobbs | 248/229.13 |
| 1,688,148 | A | * | 10/1928 | Martin | 248/229.12 |
| 1,735,212 | A | * | 11/1929 | Pawsat | 248/229.24 |
| 1,737,237 | A | * | 11/1929 | Helling | 362/397 |
| 1,774,775 | A | * | 9/1930 | Weitz, Jr. | 362/396 |
| 4,506,317 | A | | 3/1985 | Duddy | 362/396 |
| 4,907,769 | A | | 3/1990 | Hunley et al. | 248/185 |
| 4,998,187 | A | | 3/1991 | Herrick | 362/103 |
| 5,103,384 | A | | 4/1992 | Drohan | 362/190 |
| 5,515,246 | A | * | 5/1996 | Maglica | 362/473 |
| 5,658,065 | A | * | 8/1997 | Jamieson | 362/106 |
| 5,667,185 | A | * | 9/1997 | Maglica | 348/541 |

* cited by examiner

*Primary Examiner*—Sandra O'Shea
*Assistant Examiner*—David V. Hobden
(74) *Attorney, Agent, or Firm*—Fulbright & Jaworski L.L.P.

(57) ABSTRACT

An adaptor for a hand-held flashlight is disclosed, the flashlight being of the type having an elongate handle defying a battery compartment. The adaptor comprises a fitting in the form of a cylindrical handle-receiving aperture for mounting the flashlight handle detachably in a friction fit A multi-directional connector joins the flashlight fitting to one of a number of interchangeable bases, which may be coupled detachably to a mounting plate. The mounting plate may be formed with strap mounting formations for carrying a headstrap or the like. Both the base-plate and the interchangeable bases may be formed with suction caps, plugs, keyed apertures or magnets for mounting them detachably to various fixtures. As a result, the hand-held flashlight may be readily adapted for hands-free use.

15 Claims, 3 Drawing Sheets

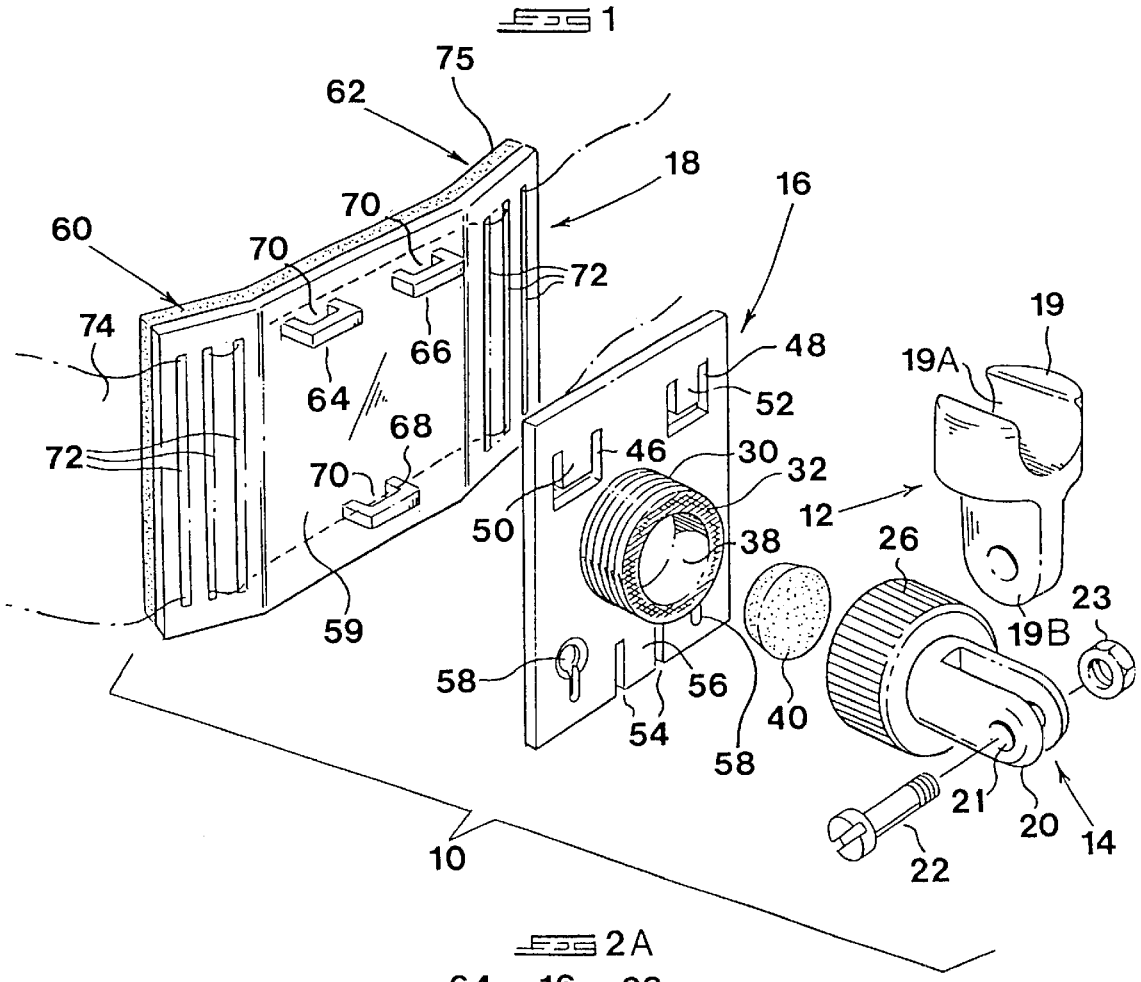
1
75
62
18
16
60
70
70
72
74
66
64
68
72
70
48
52
46
30
32
50
38
12
26
59
58
56
54
40
58
19
19A
19B
23
21
20
14
22
10
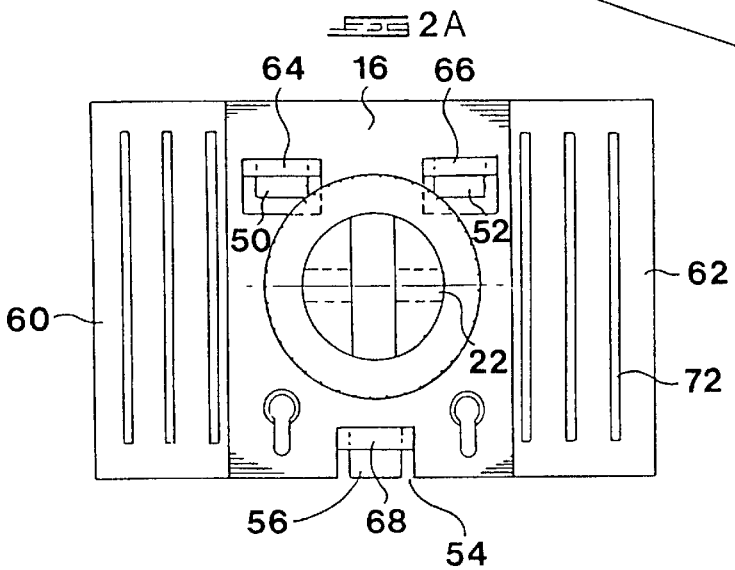
2A
64
16
66
50
52
62
60
22
72
56
68
54

FIG 2B
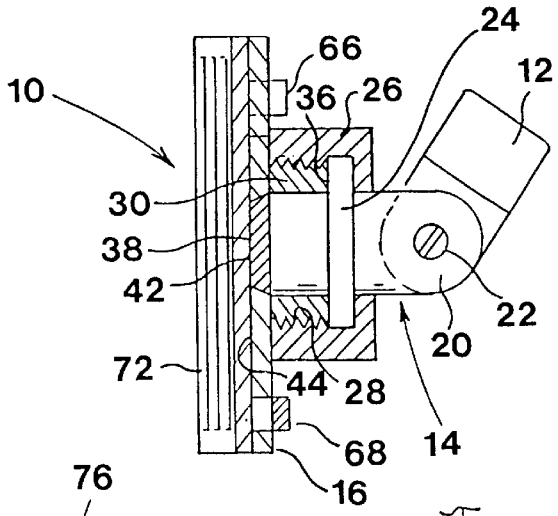
FIG 3A
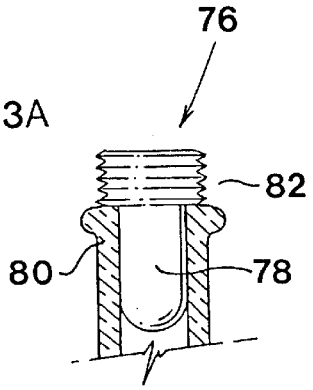
FIG 3B
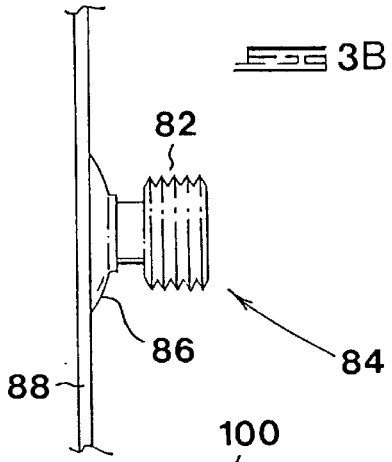
FIG 4
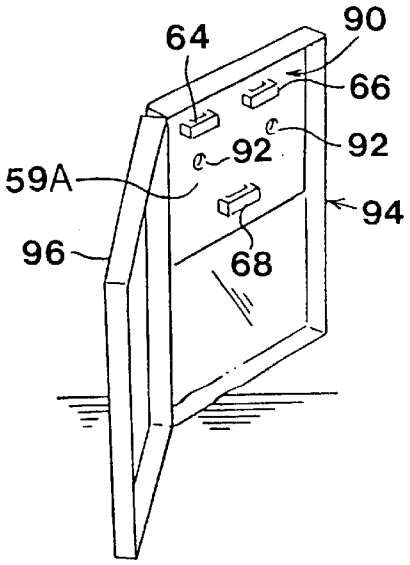
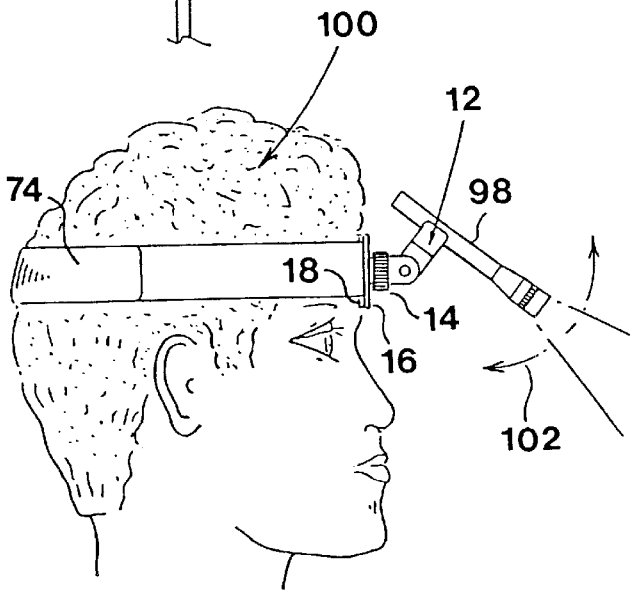
FIG 5

FLASHLIGHT ADAPTOR

RELATED APPLICATIONS

This application is a continuation of international application serial number PCT/GB94/01761 filed on Aug. 11, 1994.

BACKGROUND TO THE INVENTION

This invention relates to a flashlight adaptor.

One problem associated with a conventional battery-operated hand-held flashlight is that it does not free both hands from performing tasks which require more than one hand, unless an assistant is available to shine the flashlight in the desired direction.

Conventional headlamps address this problem, but are limited in their versatility, and while there currently exists at least one type of headlamp having an articulated strap which converts to a hand-held flashlight, its design as both a flashlight and as a headlamp is generally both complex and compromised because of the duality of function entailed.

Other flashlight adaptors aimed at converting a flashlight to a headlamp are strictly limited both in the variability of direction of the flashlight beam once the flashlight has been adapted as a headlamp, and also in regard to the possible range of adaptations which they offer both on and off the body of the user.

SUMMARY OF THE INVENTION

According to a first aspect of the invention there is provided an adaptor for a hand-held flashlight of the type having an elongate battery compartment defining a handle, the adaptor comprising:

a) a flashlight fitting defining a handle receiving formation for detachably mounting the flashlight handle, b) a plurality of interchangeable base each base having first common mounting means and second mounting means; and c) a multi-directional connector joining the flashlight fitting to a selected base via the first mounting means, the second mounting means on each base being configured to connect a particular base detachably to a first particular mounting fixture.

Preferably, the first mounting fixture comprises a mounting plate having at least one mounting formation for fitting the plate to a second particular mounting fixture.

The invention extends to an adaptor for a hand-held flashlight of the type having an elongate battery compartment defining a handle, the adaptor comprising:

a) a flashlight fitting defining a handle receiving formation for detachably mounting the flashlight handle;

b) a base having first and second mounting means;

c) a multi-directional connector joining the flashlight fitting to the base via the first mounting means; and d) a mounting plate having at least one mounting formation for mounting the plate to a second particular mounting fixture;

the second mounting means on the base being configured to connect the base detachably to the mounting plate.

Advantageously, the handle receiving formation comprises a cylindrical or part-cylindrical aperture shaped to form a friction fit with a complemental cylindrical flashlight handle. Alternatively, the handle receiving formation may comprise a cradle in the form of an adjustable chip or clamp, an adjustable strap, such as an electric strap, a buckled strap or a pair of velcro straps.

Typically, the multi-directional connector comprises a pivoting coupling located towards one end of the connector for permitting pivoting about a first axis and a rotary coupling located towards the other end of the connector for permitting rotation about a second axis which is normal to the first axis.

The pivoting coupling preferably comprises a clevis arrangement connecting the flashlight fitting and the rotary coupling comprises an internally threaded sleeve engagable with a complemental threaded spigot extending from the base.

Clamping means are conveniently provided for clamping the multi-directional connector in a predetermined fixed position so as to provide a rigid coupling between the base and the flashlight fitting.

Locking means are typically provided for locking the second mounting means on the base in engagement with complemental mounting means carried on the mounting plate.

The mounting means may comprise a strap mounting formation, and the mounting plate may comprise a headplate carrying a beadstrap, the headplate having an operatively rear surface formed to rest against the forehead of a user for allowing the hand-held flashlight to be used as a headlamp.

The locking means is conveniently located between the connector and the base for facilitating locking together of the second mounting means and the complemental mounting means The first mounting means typically comprises a threaded spigot and the multi-directional connector is fitted with a complemental internally threaded locking sleeve which is arranged to screw over the threaded spigot.

The flashlight fitting is conveniently detachably mountable to the connector, and is interchangeable with a plurality of flashlight fittings having differently sized handle-receiving formations.

The mounting formation may comprise a plurality of parallel slots, each slot having access openings so as to allow an endless strap to be fitted detachably to the mounting plate, or alternatively to provide an easily adjustable fastening means for anchoring both ends of the strap at either side of the mounting plate.

The base preferably comprises a planar base plate, a plurality of U-shaped apertures are formed through the base plate so as to define tab formations, and the mounting plate has a central planar zone from which a plurality of corresponding eye formations extend, the tab formations being arranged to slot into the eye formations so that the planar zone and an operatively rear surface of the base plate are brought into contact with one another.

Typically, the threaded locking sleeve, when fully screwed over the threaded spigot, is arranged to lock the eye formations in engagement with the tab formations.

A second mounting means on one of the bases may comprise a suction cap for mounting the base detachably to a planar mounting fixture such as a window.

The second mounting means may further comprise a plug sized to mount the base detachably within an aperture. such as that defined in a bottle neck.

The second mounting means may still further comprise a keyed aperture for receiving an elongate fixing element such as a nail or screw, and/or a magnet for mounting the base detachably to a magnetic surface.

The first mounting fixture may comprise a container for housing the adaptor, the container being adapted to serve as a stand, and the second mounting means being detachably connectable to complemental mounting formations carried on the container.

The second mounting fixture may also comprise a container for housing the adaptor, and the mounting plate may be arranged to be mounted with the container, which is adapted to serve as the stand.

The mounting formation on the mounting plate may comprise at least one of the following, namely a suction cap, a plug, a keyed aperture, or a magnet.

The first and second mounting fixtures may comprise an item of headgear, such as a helmet.

BRIEF DESCRIPTION OF THE DRAWINGS

FIG. 1 shows an exploded perspective view of one embodiment of a flashlight adaptor of the invention;

FIGS. 2A and 2B show respective front and partly cutaway side assembled views of the flashlight adaptor of FIG. 1;

FIGS. 3A and 3B show two alternative embodiments of base units forming part of the flashlight adaptor of the invention;

FIG. 4 shows an alternative embodiment of a mounting plate mounted within a presentation box;

FIG. 5 shows a side view of one embodiment of the flashlight torch adaptor of the invention being worn as a headlamp.

DESCRIPTION OF EMBODIMENTS

Figure 6:
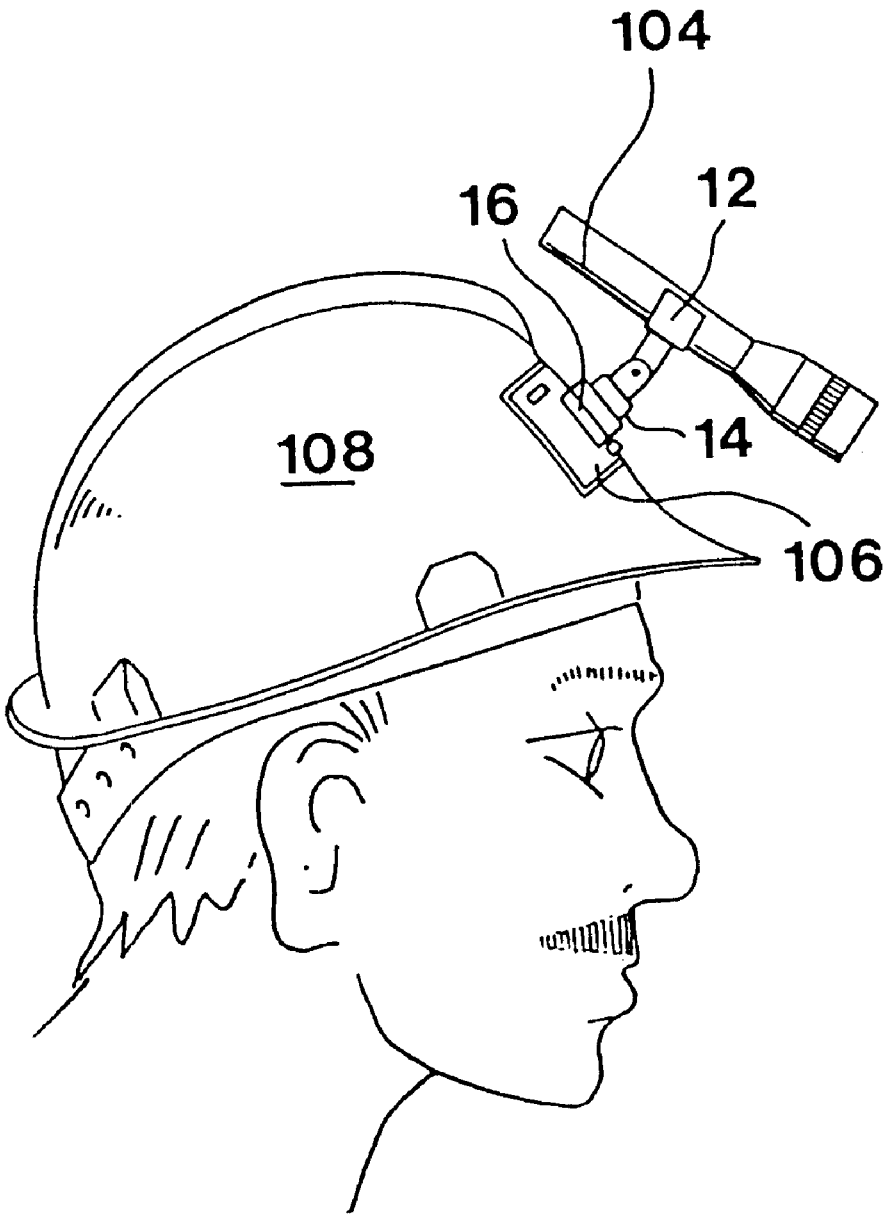
FIG. 6 shows a side view of another embodiment of the flashlight adaptor of the invention used to mount a flashlight to a construction worker's hard hat.

Referring first to FIG. 1, a first embodiment of a headlamp adaptor 10 includes a flashlight fitting 12, a connector 14, a base plate 16 and a forehead mounting plate 18. The flashlight fitting 12 is in the form of a mounting bracket 19 having a transversely extending cylindrical aperture 19A which is sized to accommodate the elongate cylindrical handle of a hand-held flashlight in a snug friction fit. An apertured lug 19B extends from the base of the mounting bracket, and is mounted pivotably on a clevis 20 extending from the forepart of the connector 14. The clevis 20 has a pair of apertures 21 through which a hinge bolt 22 is arranged to pass, and then secured in position by means of a nut 23.

Tightening the hinge bolt 22 serves to compress inwardly the arms of the clevis 20, thereby complementing the friction fit of the lug 19B with the inner surfaces of the arms of the clevis.

Referring now to FIG. 2B, the rear portion of the connector is provided with a circumferential flange 24 over which a locking sleeve 26 fits rotatably. The locking sleeve has an internally threaded opening, as is shown at 28, which is arranged to screw onto a complementary threaded spigot 30 extending from the base plate 16. The spigot 30 has an end face 32, which may be knurled, and which abuts the rear face 36 of the flange 24, which may be similarly knurled. As a result, the connector 14 is able to rotate freely relative to the base plate 16 on initial screwing down of the spigot As the locking sleeve 26 is tightened over the spigot, the faces 32 and 36 come into frictional engagement with one another, and the connector is locked into position The spigot 30 of the base plate surrounds and defines a central aperture 38 which is sized to accommodate a magnetic plug 40 in a press fit. The magnetic plug has a rear surface 42 which is arranged to lie flush with the rear surface 44 of the base plate when the plug is mounted in position. As a result, the base plate may be secured on magnetic planar surfaces such as vehicle bodies, chassis and the like.

A pair of U-shaped notches 46 and 48 are formed in the base plate as to define respective tabs 50 and 52. A pair of parallel notches 54 extend inwardly from a lower edge of the base plate and define a similarly shaped tab 56. A pair of countersunk keyhole slots 58 are also formed in the base plate 16, and are used to suspend the base plate from a corresponding pair of nails or screws projecting from a wooden fixture or the like.

The forehead plate 18 has a central planar mounting zone 59 for receiving the base plate 16, and is located between a pair of rearwardly inclined flanks 60 and 62. The planar zone 59 has three rectangular eye formations 64, 66 and 68 defining rectangular apertures 70 sized to receive the respective tabs 50, 52 and 56. It can clearly be seen in FIGS. 2A and 2B how the tabs 50, 52 and 56 slide snugly into the apertures 70 of the eyes 64, 66 and 68. With the locking sleeve 26 screwed down in position over the threaded spigot 30, it is also clear in FIG. 2A how the locking sleeve has the effect of holding the eyes 64 and 66 captive on their respective tabs 50 and 52. Only once the sleeve 26 has been unscrewed from the spigot to the extent that the lowermost edge of the sleeve is spaced a distance away from the upper surface of the base plate which exceeds the thickness of the eye formations 64 and 66, can the base plate be disengaged from the mounting plate.

Each flank 60 and 62 is formed with three parallel elongate slots 72 to which a headstrap 74 is threaded in the manner illustrated in FIG. 1. As the headstrap 74 passes behind the front planar zone 59, it doubles as a cushion for the forehead. In addition, the curved shape of the forehead plate is designed to rest snugly around the forehead of a user, and is further cushioned by a compressible pad 75.

Turning now to FIG. 3A, an alternative embodiment of a base 76 is shown having a resiliently deformable plug 78 which is sized To fit into the neck 80 of a beer bottle or the like. A relatively rigid threaded spigot 82 extends from the plug. The spigot 82 has the same cross sectional dimension as the spigot 30, and is designed to screw into the internally threaded sleeve 26 of the connector 14, thereby allowing the bottle to act as a stand for the flashlight.

In FIG. 3B, an alternative base 84 is shown in which the threaded spigot 82 terminates in a suction cap 86. The suction cap is arranged to adhere to a smooth planar surface such as a sheet of glass 88, which permits the flashlight to be anchored to the outer or inner surface of a car window or the like.

Turning now to FIG. 4, an alternative embodiment of a mounting plate 90 is shown, essentially comprising a planar zone 59A carrying the three rectangular eyes 64, 66 and 68. A pair of countersunk apertures 92 are also formed in the mounting plate, and may be used to screw or nail the mounting plate onto a wooden backing fixture such as tree trunk or the like. In the particular embodiment illustrated, the mounting plate 90 is fitted snugly within the base of a presentation box 94. With the Lid 96 of the presentation box opened at an angle in the region of 90° or more, a relatively sturdy stand is formed onto which the baseplate 16 carrying the connector 14 and the flashlight fitting 12 may be detachably mounted. All of the components thus far described may be incorporated within the presentation box 94.

Turning now to FIG. 5, a conventional short-bodied flashlight 98 is shown mounted in position on the fitting 12, with the connector 14 being screwed down onto the base plate 16. The base plate 16 is in turn fitted to the forehead plate 18, with the headstrap 74 being worn around the head 100 of a user.

Omni-directional movement of the flashlight is possible, as the flashlight is able to pivot in the plane of the page in the direction of arrows 102 by pivoting on the hinge bolt. Likewise, the flashlight is able to rotate about the central axis of the locking sleeve and spigot. The flashlight may be locked in any desired position by tightening down of the locking sleeve and of the nut on the hinge bolt.

FIG. 6 shows a conventional mini-flashlight 104 mounted in position on the fitting 12, with the base plate 16 being carried on a mounting plate 106 and locked into position by means of the connector 14. The mounting plate 106 is affixed to a planar surface in the front of a construction helmet 108. The mounting plate 106 may alternatively be pressed or moulded into the helmet as it is being formed.

The flashlight adaptor of the invention is designed to accommodate rather than to convert a conventional hand-held flashlight for use, inter alia, as a headlamp. The intrinsic design advantages of a relatively high quality hand-held flashlight, such as its slim profile, its cylindrical shape, waterproofing, and absence of multiple seams and folds, are enhanced rather than compromised by the adaptor of the invention. A further significant advantage offered by the various combinations of bases and mounting plates is that the flashlight adaptor is suited to a wide number of applications, and an equally wide variety of classes of users and may readily be adapted for such applications both on and off the body of the user.

We claim:

1. An adaptor for a hand-held flashlight of the type having an elongate battery compartment defining a handle, the adaptor comprising:

a) a flashlight fitting defining a handle receiving formation for detachably mounting the flashlight handle;

b) a multi-directional connector extending from the flashlight fitting and terminating in first mounting means;

c) a first base having second mounting means for mounting the first base detachably to the first mounting means, and third mounting means;

d) a first mounting place having fourth mounting means for mounting the first mounting plate detachably to the third mounting means and a first mounting formation for fitting the mounting plate to a first fixture; and e) locking means for simultaneously locking together the third and fourth mounting means, when the first and second mounting means are inter-engaged.

2. An adaptor according to claim 1 which includes at least a second base which is interchangeable with the first base, the second base having second mounting means which is similar to the second mounting means of the first base and third mounting means which is different from the third mounting means of the first base for mounting the second base to a second fixture.

3. An adaptor according to claim 2 which includes a second mounting plate having fourth mounting means which is similar to the fourth mounting means of the first mounting plate for mounting the second mounting plate detachably to the third mounting means and a second mounting formation which is different to the first mounting formation for supporting the second mounting plate on a third fixture.

4. An adaptor according to claim 1 in which the locking means is enabled by tightening of the first and second mounting means and is disabled by loosening of the first and second mounting means.

5. An adaptor according to claim 1 in which the first base comprises a planar base plate, the second mounting means comprises a threaded spigot extending from the base plate and the first mounting means comprises a complemental internally threaded locking sleeve which is arranged to screw down over the spigot.

6. An adaptor according to claim 5 in which a plurality of U-shaped apertures are formed through the base plate so as to define tab formations, and the mounting plate has a central planar zone from which a plurality of corresponding eye formations extend, the tab formations being arranged to slot into the eye formations so that the planar zone and an operatively rear surface of the base plate are brought into contact with one another.

7. An adaptor according to claim 6 in which the locking means comprises the locking sleeve which is dimensioned to at least partly obturate the U-shaped apertures when fully screwed over the threaded spigot, thereby to prevent retraction of the eye formations from the tab formations.

8. An adaptor according to claim 1 which includes a plurality of ancillary flashlight fittings having differently sized handle-receiving formations with which the flashlight fitting is interchangeable.

9. An adaptor according to claim 1 in which the first mounting plate comprises a headplate carrying a headstrap, the headplate having an operatively rear surface formed to rest against the forehead of a user for allowing the hand-held flashlight to be used as a headlamp.

10. An adaptor according to claim 3 in which the second mounting plate comprises a helmet.

11. An adaptor according to claim 2 in which the second base comprises a mounting plug, the third mounting means comprising a plug sized to mount the base detachably within an aperture, such as that defined by a bottle neck.

12. An adaptor according to claim 2 in which a plurality of second bases are provided, the second bases being at least one member selected from the group consisting essentially of a suction cap assembly, a magnet assembly and a keyed aperture arrangement.

13. An adaptor according to claim 5 in which the threaded spigot is formed with a central axially extending aperture, and a magnetic insert is located within the aperture, the magnetic insert having a front face which is flush with an operatively rear surface of the base plate.

14. An adaptor according to claim 3 in which the second mounting plate comprises a container for housing the adaptor, said container serving as a stand or support for supporting the flashlight on a substantially level surface.

15. An adaptor according to claim 2 in which the first mounting means comprises a threaded spigot and the multidirectional connector is fitted with a complemental internally threaded locking sleeve which is arranged to screw over the threaded spigot.

* * * * *